US006705352B1

(12) United States Patent
Speich

(10) Patent No.: US 6,705,352 B1
(45) Date of Patent: Mar. 16, 2004

(54) LABEL, METHOD FOR PRODUCING LABELS AND DEVICES FOR IMPLEMENTING SAID METHOD

(75) Inventor: Francisco Speich, Gipf-Oberfrick (CH)

(73) Assignee: Textilma AG, Hergiswil (CH)

( * ) Notice: Subject to any disclaimer, the term of this patent is extended or adjusted under 35 U.S.C. 154(b) by 0 days.

(21) Appl. No.: 09/980,293

(22) PCT Filed: Jul. 27, 1999

(86) PCT No.: PCT/CH99/00348

§ 371 (c)(1),
(2), (4) Date: Nov. 29, 2001

(87) PCT Pub. No.: WO00/73562

PCT Pub. Date: Dec. 7, 2000

(30) Foreign Application Priority Data

May 29, 1999 (CH) ..... 1011/99

(51) Int. Cl.[7] ..... B32B 3/04

(52) U.S. Cl. ..... 139/387 R; 428/124; 428/126; 156/88

(58) Field of Search ..... 139/387 R; 428/124, 428/126, 542.6, 906.6; 156/88, 204, 259; 83/910; 2/244, 245, 246

(56) References Cited

U.S. PATENT DOCUMENTS 4,517,910 A * 5/1985 Jalowsky ..... 112/439
4,584,785 A * 4/1986 von Danwitz ..... 40/316
5,112,420 A * 5/1992 Diesner ..... 156/88
5,832,540 A * 11/1998 Knight ..... 2/247
6,119,614 A * 9/2000 Kimura ..... 112/475.26
6,263,817 B1 * 7/2001 Tajima et al. ..... 112/475.22
6,279,170 B1 * 8/2001 Chu ..... 2/246
6,432,235 B1 * 8/2002 Bleckmann et al. ..... 156/73.1

FOREIGN PATENT DOCUMENTS

| | | |
|---|---|---|
| DE | 9219185 | 7/1992 |
| EP | 0389793 | 2/1990 |
| EP | 0427933 | 6/1990 |
| EP | 0546485 | 5/1992 |

* cited by examiner

*Primary Examiner*—John J. Calvert
*Assistant Examiner*—Robert H. Muromoto, Jr.
(74) *Attorney, Agent, or Firm*—Hovey Williams LLP

(57) ABSTRACT

The label has two non-folded longitudinal sides (1) and two foldable narrow sides (2) and consists of a backing fabric (11) with warp threads (4) and basic picks (5), in addition to embroidery picks (12) made of a fusible thread material forming the pattern. The embroidery picks (12) forming the pattern extend parallel and at a distance to the unfolded longitudinal sides (1) of the backing fabric (11). The non-folded longitudinal side (1) is an edge of a cut formed in the backing fabric outside the area (13) of the pattern. The label has the advantage that the edges of the cuts on the longitudinal sides are soft and skin friendly thereby substantially improving wearing comfort. Due to the fact that the edge of the cuts produced by the basic picks have practically no brows and the picks extend parallel in relation to the longitudinal side of the labels, and even appearance is achieved on the entire length of the label since the picks cover evenly the back part.

12 Claims, 4 Drawing Sheets

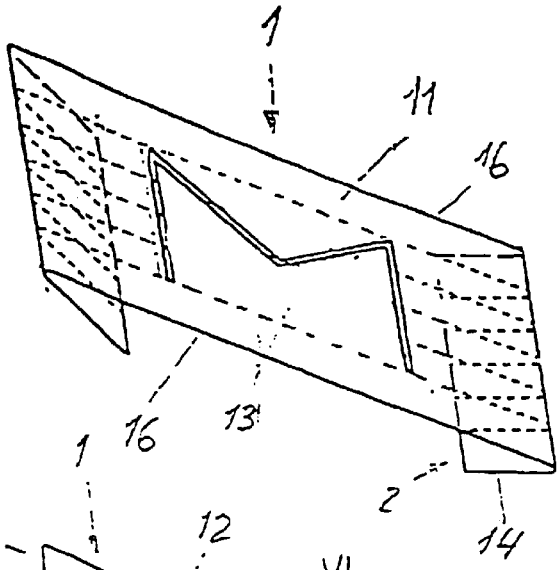
Fig. 4
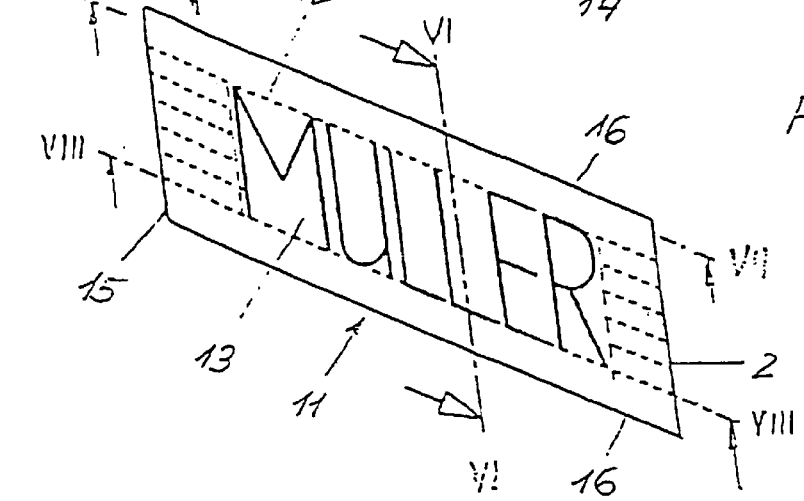
Fig. 5
Fig. 6
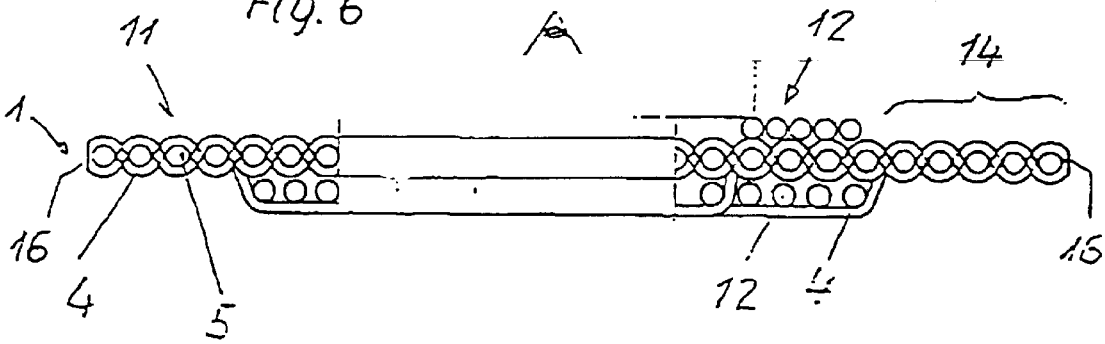

LABEL, METHOD FOR PRODUCING LABELS AND DEVICES FOR IMPLEMENTING SAID METHOD

BACKGROUND OF THE INVENTION

1. Field of the Invention

The invention relates to a label made by the woven fabric technique and a method of making the label, the label being provided with non-folded cut longitudinal sides and with foldable cut narrow sides running transversely to the longitudinal sides. The labels have a backing fabric formed from at least two warp threads and one ground weft thread and having a plurality of embroidery weft threads of fusible thread material forming a figure.

2. Description of the Prior Art

As is known the labels are woven in the form of bands in a broad fabric composed of fusible yarns, a repeat being provided for each band. The broad fabric consists of a backing fabric consisting of warp threads, a ground weft and of embroidery wefts which are led over the entire web breadth and which form a figure of the label. The bands are subsequently cut out of the textile web in the form of strips running in the warp direction on their longitudinal side, the backing fabric and the embroidery wefts being severed. If a thermal cutting device is used for this purpose, the fusion of the backing fabric and of the embroidery weft threads gives rise to the known hard and rough fusion edges which are very thick and unpleasant.

FIG. 1 shows a version of a label known from WO 9302246. The label has, as is customary, a quadrangular shape with longitudinal sides 1 and narrow sides 2. The label consists of the backing fabric 3 and embroidery wefts which, in one region of the label, produce a figure such that there is in each case an edge of backing fabric on the narrow sides. The label is woven in such a way that the warp threads 4 run parallel and the weft threads 5 transversely to the longitudinal sides 1 of the label. The longitudinal sides of the label are cut by a thermal cutting device. The backing fabric and the embroidery wefts are thereby fused together, so that the disturbing fusion edge 6 is formed. The label according to FIG. 1 is folded on the narrow sides (only one fold illustrated), so that the fusion edge 6 is free. In this prior art, to avoid the undesirable fusion edges, the fusion edge is machined by a pressing and/or vibrating tool for non-cutting shaping, this being labor-intensive, but still not affording the desired effect.

The same problem is also addressed in EP-A-0 389 793, in which it is referred to as useless to experiment at the fusion edges (column 1, lines 42 to 54). Instead, a complicated method is postulated, whereby the labels are produced in a two-stage method. In a first method stage, a semi-finished product with a cut longitudinal side and with greater breadth is produced. In a second method stage, the semi-finished product is folded at the margin to the final breadth and bonded adhesively on the rear side. Such a label is illustrated in FIG. 2 and is folded on the longitudinal sides in order to cover the fusion edge 6. This label may also be provided with end folds 7. The label is fastened on the narrow sides, so that the longitudinal sides 1 come into contact with the skin and an article of clothing. This side should have as soft an edge as possible, so that the article of clothing feels pleasant to wear and in order to avoid damage to the article of clothing and places on the human body where friction occurs. In order to achieve this, it is proposed, in EP-A-0 389 793, to provide a fold on the label in each case on the free longitudinal sides having the fusion edge and on the narrow side.

Apart from the complicated and costly production, it is also considered a disadvantage that the warp threads of the backing fabric run in the longitudinal direction of the label and the number of these is fixed, so that labels can be produced only in a specific quality, and that, for folding, the label has to be woven as a semi-finished product with larger dimensions. The folding of the longitudinal side having the fusion edge formed by the fused ground wefts and embroidery wefts leads to very thick and uncomfortable margins on the labels. If, in addition, an end fold is provided, the label consists of four layers in this region, and this is unacceptable to the user and the wearer.

If, as described in EP-A-0 546 485, the textile web is severed by means of a mechanical cutting device and a number of longitudinal threads are removed at the separating point by mechanical means, a fringed edge is formed on the longitudinal side of the label. It is considered a disadvantage that a margin consisting of backing fabric must likewise be provided in order to form the fringed edge, so that, for folding, the label has to be woven as a semi-finished product with larger dimensions and a special outlay is necessary in order to form the fringed edge. In addition to the complicated production method, another disadvantage is that further longitudinal threads may come loose at the fringed edge, so that the label becomes useless or unsightly.

The known method for the production of labels have the disadvantages that the folding of the longitudinal side necessitates a higher outlay in terms of adhesive bonding, and that, because of the dimensions of the semi-finished product, the weaving breadth of the weaving machine is utilized to only a restricted extent or there is a relatively large amount of waste.

SUMMARY OF THE INVENTION

The invention is intended to remedy this. The object on which the invention is based is to improve a label.

This object is achieved, according to the invention, by means of a label having two first non-foldable sides and two second foldable sides running transversely to the foldable sides. The label is made by the woven-fabric technique, with at least two warp threads and a ground weft thread for the backing fabric and also with a plurality of embroidery weft threads for making a figure. The embroidery thread is provided of fusible thread material. The embroidery wefts form the figure which runs parallel to and at a distance from the first non-folded sides of the backing fabric, and the non-folded sides are formed by cutting, outside the region of the figure, in the backing fabric.

It was found, surprisingly, that, by the longitudinal side being arranged transversely to the warp threads and by the embroidery weft threads being arranged at a distance from the longitudinal sides, and with production being carried out in the simplest possible way, the cut edge on the non-folded longitudinal side of the label is soft and skin-friendly and wearing comfort is improved appreciably because the cut edge produced by the ground wefts has virtually no brows. The cut edges can be covered by the narrow side being folded, with the result that the label is further improved. Since the weft threads run parallel to the longitudinal side of the label, a uniform appearance is achieved over the entire length of the label, because the weft threads cover the rear side uniformly.

A method for the production of labels is characterized, according to the invention, wherein a broad fabric is produced with fusible thread material by the woven-fabric technique with at least two warp threads and with a ground weft for the backing fabric, and also with a plurality of embroidery wefts for providing a figure. The broad fabric is separated after weaving by cutting the broad fabric into a set of strips lying next to one another. The broad fabric is woven in such a way that a plurality of labels lie next to one another with their first non-folded side in the weft direction and with their second foldable side in the warp direction. The broad fabric is cut along the second side in order to produce strips with transversely lying labels succeeding one another in the direction of run of the broad fabric.

The further advantages which can be achieved by means of the method according to the invention are to be seen in that labels of different length and breadth are woven on the same type of weaving machines. Labels with a weave repeat can be woven up to a weaving breadth of about 115 cm, so that only a small amount of waste occurs. The weft density in the backing fabric can be selected so that labels with simulated weaves, such as taffeta, half-satin and satin, that labels of different length and breadth are woven on the same type of weaving machine. Labels with a weave repeat can be woven up to a weaving breadth of about 115 cm, so that only a small amount of waste occurs. The weft density in the backing fabric can be selected so that labels with simulated weaves, such as taffeta, half-satin and satin, are produced on the same weaving machine. In the marginal region of the strips, the embroidery threads can be removed, so that the end fold becomes very thin.

An apparatus for carrying out the method is characterized by a weaving machine with a jacquard apparatus for individual heddle control, but a cutting device, and by a folding device.

The invention is explained below with reference to the accompanying drawings in which:

BRIEF DESCRIPTION OF THE DRAWINGS

FIG. 4 shows a three-dimensional illustration of a modified version of the label according to the invention shown in FIG. 3;

FIG. 5 shows a three-dimensional illustration of another version of the label according to the invention;

FIG. 6 shows a section along the line VI—VI in FIG. 5 on a larger scale;

DESCRIPTION OF THE PREFERRED EMBODIMENTS

Figure 1:
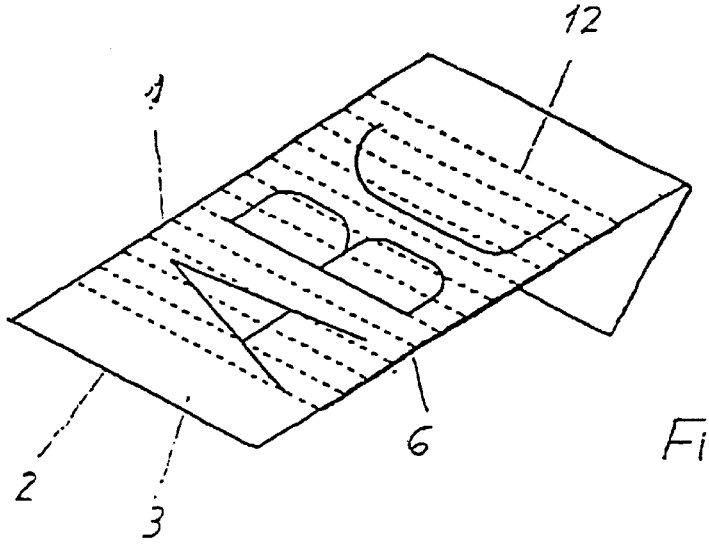
FIG. 1 shows a three-dimensional illustration of a version of a known label.
Figure 2:
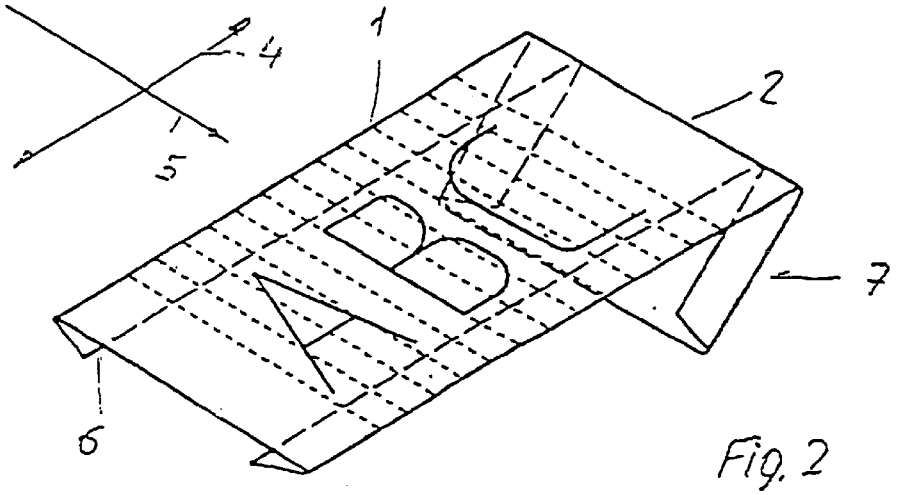
FIG. 2 shows a modified version of the label according to FIG. 1.
Figure 3:
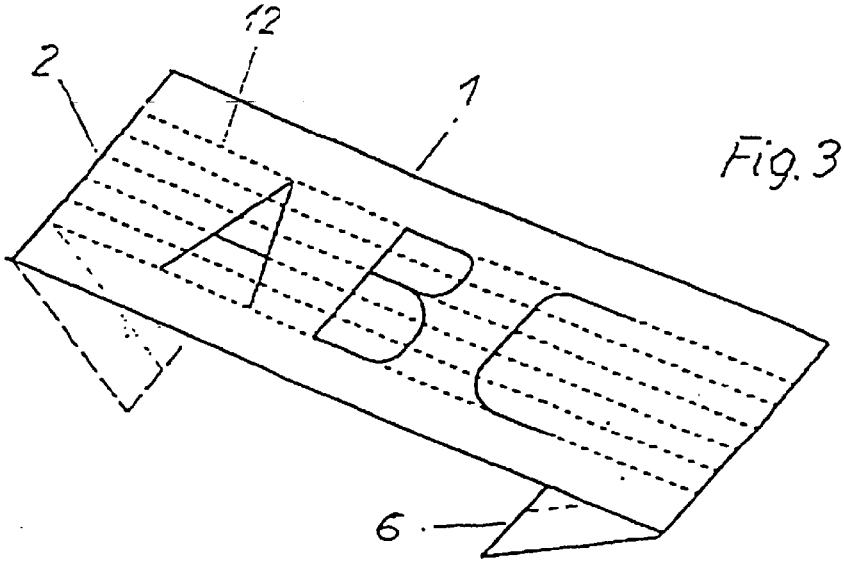
FIG. 3 shows a three-dimensional illustration of a version of a label according to the invention.
Figure 7:
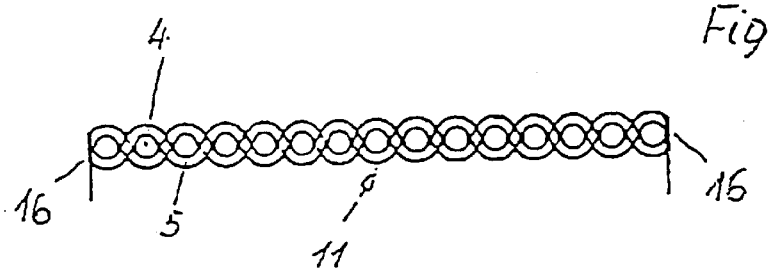
FIG. 7 shows a section along the line VII—VII in FIG. 5.
Figure 8:
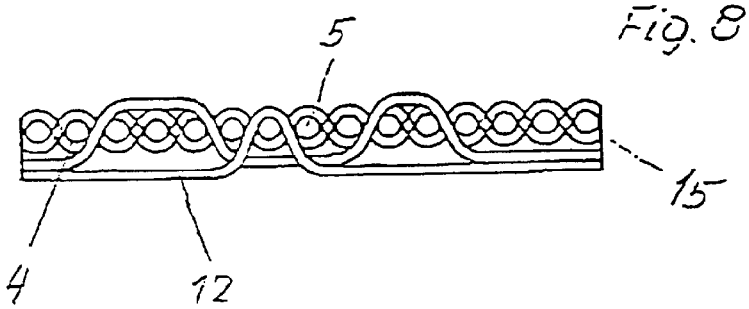
FIG. 8 shows a section along the line VIII—VIII in FIG. 5.

FIG. 3 shows a label according to the invention, from the illustration of which the difference from the known label according to FIGS. 1 and 2 as regards the warp direction and weft direction can be seen clearly and which is explained by the following description with reference to FIGS. 4 to 8.

The label has, as is customary, a quadrangular shape with two non-folded longitudinal sides 1 and two foldable narrow sides 2. The label consists of a backing fabric 11 and of a plurality of embroidery wefts 12 which, in a region 13 of the label, produce a figure such that a margin 14 of backing fabric is present on the longitudinal sides, and which are tied in a floating manner on the rear side of the label. The label is woven in such a way that the warp threads 4 run transversely to and the weft threads 5 parallel to the longitudinal side 1 of the label. The narrow sides 2 of the label which are cut by a thermal cutting device have a cut edge at which the backing fabric 11 and the embroidery wefts 12 floating on the rear side of the label are fused, a fusion edge 15 being formed. The label may be folded on the narrow sides in order to cover the fusion edge. The longitudinal sides of the label which are cut by a cutting device run through the backing fabric 11 and have a cut edge 16 which, as already mentioned, is advantageously soft and skin-friendly.

Figure 9:
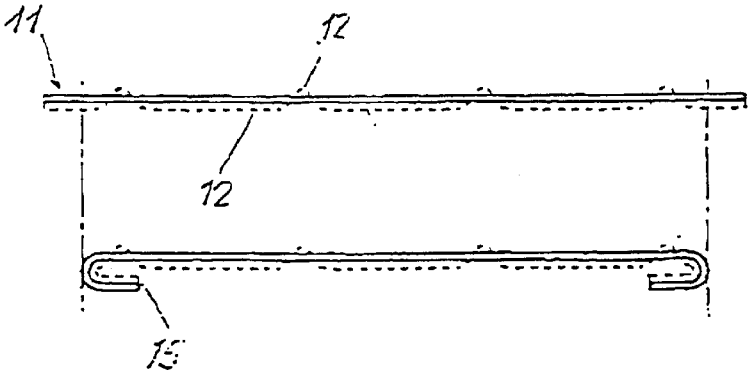
FIG. 9 shows a side view of the label according to FIG. 5 with and without a folded narrow side.
Figure 10:
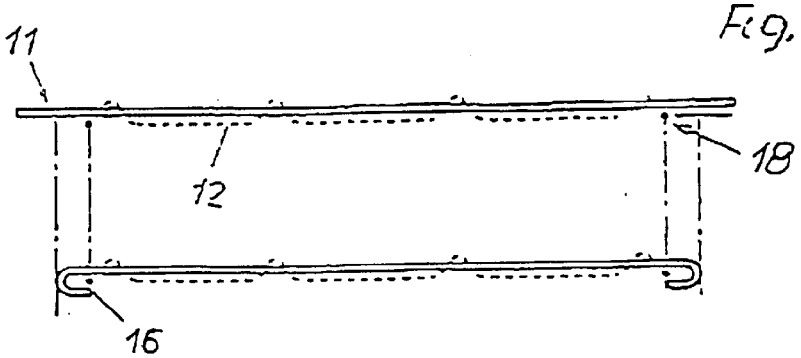
FIG. 10 shows a side view of a modified version of the label according to FIG. 5 with and without a folded narrow side.

Reference is made to FIGS. 9 and 10. As FIG. 9 shows, the label consists of a backing fabric 11 and of a plurality of embroidery wefts 12 which, in the region 13 of the label, produce a figure and are tied in a floating manner on the rear side of the label, the label being folded on the narrow sides. FIG. 10 shows a label, in which the floating embroidery wefts 12 are removed on the rear side in the region of the narrow side, so that, in each case, a portion 18 of the backing fabric 11 is free. These portions 18 are folded, so that a very thin label is achieved.

Figure 11:
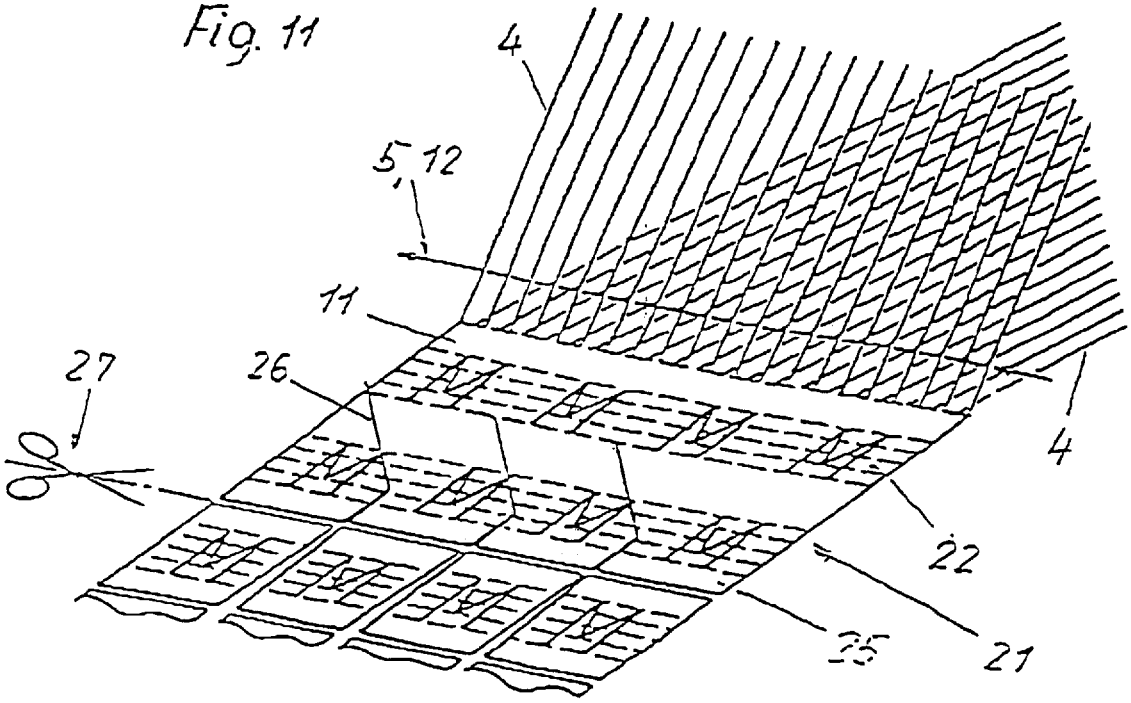
FIG. 11 shows a diagrammatic illustration of a method for the production of the label.

The method for producing the label is described below. As shown in FIG. 11, to produce the labels, in a first step a broad fabric 21 of fusible thread material is produced, which has a number of labels 22 lying next to one another and which is woven continuously according to a repeat extending over the weaving breadth. The broad fabric 21 is woven by the woven-fabric technique with warp threads 4 and ground wefts 5 for a backing fabric 11 and also with a plurality of embroidery wefts 12 (FIG. 8) for the figure, the embroidery wefts being woven in a region 13 of each label. In a second step, the broad fabric 21 is separated into a set of strips 25 which contain transversely lying labels 22 succeeding one another in the longitudinal direction of the strips. For separation, a thermal cutting device 26 is provided, which either is arranged on the weaving machine or is a separate device. If the broad fabric 21 is divided into strips 25, the strips 25 are wound up for further processing. If the broad fabric 21 is not divided into strips, the broad fabric is wound onto a cloth beam (not illustrated). The strips 25 are a semi-finished product for the labels. In a third step, the strips 25 are folded on the narrow sides [lacuna] a folding device, the length of the label being determined and the narrow side of the label being formed. Simultaneously with folding, the folded portion is fixed, known methods being used. The folded strips are separated by means of mechanical, thermal or ultrasonic devices 27, at the same time the width of the label being determined and the cut edge running through the backing fabric.

Figure 12:
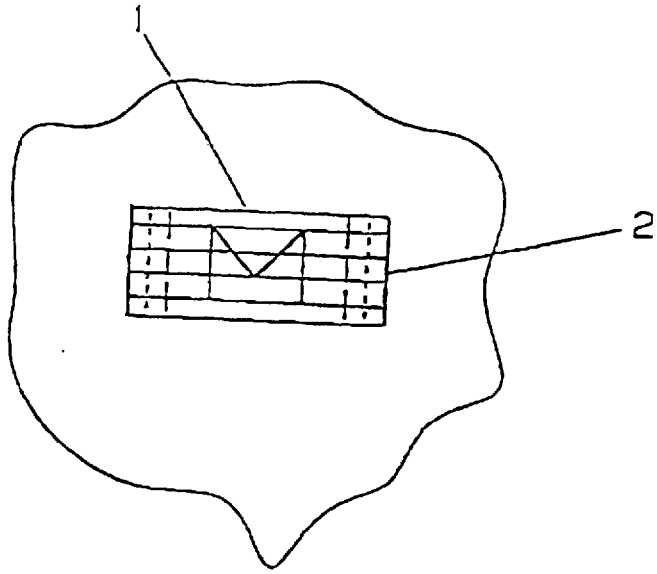
FIG. 12 shows an application of the label according to the invention.

FIG. 12 shows the application of the label. The label is stitched with the folded narrow sides to an article of clothing, so that the fusion edge lies underneath the label and the longitudinal side having the soft edge is free.

What is claimed is:

1. A label made by the woven fabric technique comprising:

non-folded cut longitudinal sides;

foldable cut narrow sides running transversely to the longitudinal sides; and a backing fabric formed from at least two warp threads and at least one ground weft thread and a plurality of embroidery weft threads of fusible thread material for a figure, wherein the longitudinal sides are oriented transversely to the warp threads and the embroidery weft threads forming a figure run parallel to and at a distance from the longitudinal sides.

2. A method for the production of labels as claimed in claim 1, comprising the steps of:

producing a broad fabric of fusible thread material with a backing fabric from at least two warp threads and one ground weft thread and also from a plurality of embroidery weft threads for the figure;

separating the broad fabric after weaving by means of cutting the broad fabric into a set of strips;

lying the strips next to one another and having successive labels; and wherein the labels in the broad fabric are oriented with their longitudinal sides transverse to the warp threads.

3. The method as claimed in claim 2, wherein the broad fabric is woven according to at least one wave repeat.

4. The method as claimed in claim 2, wherein the embroidery weft threads are removed in the marginal region of the narrow sides.

5. The method as claimed in claim 2, wherein after cutting, the strips are folded in the marginal region of the narrow sides, in order to produce labels of predetermined length.

6. The method as claimed in claim 2, wherein the labels are singled out along their longitudinal sides by the cutting of the backing fabric in order to produce labels with a predetermined breadth.

7. The method as claimed in claim 3, wherein the embroidery weft threads are removed in the marginal region of the narrow sides.

8. The method as claimed in claim 3, wherein after cutting, the strips are folded in the marginal region of the narrow sides, in order to produce labels of predetermined length.

9. The method as claimed in claim 4, wherein after cutting, the strips are folded in the marginal region of the narrow sides, in order to produce labels of predetermined length.

10. The method as claimed in claim 3, wherein the labels are singled out along their longitudinal sides by the cutting of the backing fabric in order to produce labels with a predetermined breadth.

11. The method as claimed in claim 4, wherein the labels are singled out along their longitudinal sides by the cutting of the backing fabric in order to produce labels with a predetermined breadth.

12. The method as claimed in claim 5, wherein the labels are singled out along their longitudinal sides by the cutting of the backing fabric in order to produce labels with a predetermined breadth.

* * * * *